United States Patent [19]

Yagi et al.

[11] 4,228,203

[45] Oct. 14, 1980

[54] METHOD OF FORMING ALUMINUM COATING LAYER ON FERROUS BASE ALLOY WORKPIECE

[75] Inventors: Toshiro Yagi; Junichi Yamamoto; Hideo Kohara, all of Hiroshima, Japan

[73] Assignee: Toyo Kogyo Co., Ltd., Japan

[21] Appl. No.: 5,914

[22] Filed: Jan. 23, 1979

[30] Foreign Application Priority Data

| | | | |
|---|---|---|---|
| Jan. 27, 1978 | [JP] | Japan | 53/8491 |
| Feb. 1, 1978 | [JP] | Japan | 53/11020 |
| Sep. 13, 1978 | [JP] | Japan | 53/113127 |

[51] Int. Cl.[3] ..... C23C 9/00

[52] U.S. Cl. ..... 427/229; 427/376.8; 427/383.9

[58] Field of Search ..... 427/229, 383 D, 376 H, 427/376.8, 383.9

[56] References Cited

U.S. PATENT DOCUMENTS

| | | | |
|---|---|---|---|
| 1,655,269 | 1/1928 | Howe | 427/229 |
| 1,829,623 | 10/1931 | Wright | 427/229 |
| 2,885,304 | 5/1959 | Thomson et al. | 427/229 |
| 3,107,175 | 10/1963 | Cape | 427/229 |
| 3,720,537 | 3/1973 | Rigney | 427/229 |
| 3,884,729 | 5/1975 | Jackson | 427/376 H |
| 3,907,611 | 9/1975 | Sasame et al. | 148/6.3 |
| 4,045,596 | 8/1977 | Guiraldenq et al. | 427/229 |
| 4,141,760 | 2/1979 | Baldi | 427/383 D |

FOREIGN PATENT DOCUMENTS

52/108344 9/1977 Japan .

OTHER PUBLICATIONS

Goetzel, Treatise on Powder Metallurgy, vol. 1, 1949 Interscience, pp. 254, 255.

*Primary Examiner*—Ralph S. Kendall

*Attorney, Agent, or Firm*—Wenderoth, Lind & Ponack

[57] ABSTRACT

The disclosure relates to a method of forming aluminum coating layer on surface of a ferrous base alloy workpiece which includes the steps of applying onto the surface of the ferrous base alloy workpiece a coating solution containing 50 to 90% by weight of aluminum or aluminum alloy particles and 10 to 50% by weight of synthetic resin having a high decomposition burning temperature with slow burning speed and being soluble in a solvent at normal temperature, with subsequent drying to form a resin coating layer containing aluminum on the surface of the ferrous base alloy workpiece, and then subjecting the workpiece thus treated to heating up to temperature higher than melting point of the aluminum or aluminum alloy particles so as to form an Al plated coating layer on the surface of the ferrous base alloy workpiece.

2 Claims, 7 Drawing Figures

METHOD OF FORMING ALUMINUM COATING LAYER ON FERROUS BASE ALLOY WORKPIECE

BACKGROUND OF THE INVENTION

The present invention relates to a method of forming aluminum coating layers and more particularly, to a method of forming aluminum coating layers having corrosion resistance at high temperatures and resistance against oxidation in a halogen atmosphere on surfaces of ferrous base alloy workpiece.

As is well known, exhaust gases discharged from motor vehicles contain halogen gases, halogen compounds and lead compounds, for example, $Cl_2$, $Br_2$, $PbCl_2$, $C_2H_2Cl_2$, $C_2H_2Br_2$, etc. besides unburnt noxious gases including carbon monoxide, hydrocarbon and the like, and components or parts made of ferrous base alloy material for exhaust system of the motor vehicles, for example, heat exchangers, air ducts, containers, etc. tend to be subjected to corrosion by the noxious compounds as described above. Moreover, halogen compounds (e.g. salt) employed for preventing freezing during cold seasons are liable to enter these components of ferrous base alloy material, which are then corroded by the atmosphere containing halogen gas produced when the halogen compounds are decomposed at high temperatures.

Conventionally, it has been a general practice to employ components or parts produced by forming ceramic layers on the surfaces of ferrous base alloy materials as corrosion resistant members against atmospheres containing halogen at high temperatures, but when the known corrosion resistant members as described above are used in places which are subjected to repeated heating and cooling as in the motor vehicle components, the ceramic layers tend to be peeled off in a short period of time due to difference in thermal expansion coefficients between the ferrous base alloy materials and ceramic coating layers without sufficient durability, thus not being suitable for practical application.

In order to overcome the disadvantages as described in the foregoing, the present inventors have previously proposed in U.S. Pat. Nos. 3,907,611, 3,941,569 and 4,079,157 a method of manufacturing components having high temperature corrosion resistance in a halogen atmosphere which includes the steps of dipping the workpiece of ferrous base alloy material such as stainless steel into a molten bath of Al or Al alloy to apply melt-plating on the surfaces of the workpiece, subjecting the workpiece thus prepared to heat treatment at high temperatures of 700° to 950° C. to form thereon the Al compound layer mainly composed of Al-Fe compound, and further subjecting the workpiece, if necessary, to heat treatment at temperature range of 950° to 1350° C. to form thereon the alloy layer having Fe and Al as main components.

The known method as described above, however, still has a disadvantage in that the expensive facilities are required for melting Al or Al alloy, while it is rather difficult to precisely control the thickness of the plated layer to be formed on the workpiece of ferrous base alloy material.

Meanwhile, there has also been conventionally proposed, for example, by Japanese Laid Open Patent Application Tokkaisho 52-108344, a method of manufacturing corrosion resistant members for exhaust gas treating apparatuses which includes the steps of covering the surface of the ferrous base alloy workpiece with a suspension containing water ceramic binder, aluminum particles, phosphoric acid, and chromic acid with subsequent heating and drying of the workpiece, and subjecting the workpiece thus treated to heating in the exhaust gas from engines containing residual oxygen to form a diffusion layer mainly composed of alumina on the surface of the workpiece for imparting thereto high temperature corrosion resistance. Since the corrosion resistant member obtained by the above known method, however, has its surface covered by a porous ceramic layer, with the aluminum almost oxidized to form the alumina diffusion layer, the aluminum coating layer required is not obtainable, and even when the workpiece is further heated over 700° C., it is not possible to form the Fe-Al compound layer or alloy layer mainly composed of Al and Fe, thus the resultant corrosion resistant member thus produced being considered to be comparatively inferior in the corrosion resistance at high temperatures.

SUMMARY OF THE INVENTION

Accordingly, an essential object of the present invention is to provide a method of forming aluminum coating layers on surfaces of ferrous base alloy workpieces for components and parts requiring corrosion resistance at high temperatures and resistance against oxidation which is simple in processing and suitable for mass production at high efficiency.

Another important object of the present invention is to provide a method as described above which includes the steps of applying onto a ferrous base alloy workpiece 50 to 90% by weight of Al or Al alloy particles and synthetic resin soluble by solvents at normal temperature and having a high decomposition burning temperature with a slow burning speed, and subsequently heating the workpiece to burn the synthetic resin for simultaneously subjecting the workpiece to melt-plating with Al or Al alloy particles so as to form the Al plated coating layer thereon through simple processing.

A further object of the present invention is to provide a method as described above in which the workpiece having the Al plated coating layer formed in the above described processing is further subjected to a primary heat treatment at temperatures of 700° to 850° C. for more than 10 minutes, and subsequently to a second heat treatment, depending on necessity, at temperatures of 900° to 1000° C. for more than 30 minutes so as to form an Al layer composed of compound layer or alloy layer having Al and Fe as main component on the ferrous base alloy workpiece.

A still further object of the present invention is to provide a ferrous base alloy workpiece having thereon the aluminum coating layer produced by the method as described above.

In accomplishing these and other objects, according to the present invention, there is disclosed a method of forming an aluminum coating layer on surface of a ferrous base alloy workpiece which comprises the steps of applying onto the surface of the ferrous base alloy workpiece coating a solution containing 50 to 90% by weight of aluminum or aluminum alloy particles and 10 to 50% by weight of synthetic resin having high decomposition burning temperature with slow burning speed and being soluble in solvent at normal temperature for subsequent drying thereof to form a resin coating layer containing aluminum on the surface of the ferrous base alloy workpiece, and thereafter subjecting said workpiece thus treated to heating up to temperature higher than melting point of the aluminum or aluminum alloy particles so as to form an Al plated coating layer on the surface of said ferrous base alloy workpiece. The workpiece having the Al plated coating layer formed thereon as described above is further heated at temperatures of 700° to 850° C. for more than 10 minutes for a primary heat treatment, and is subsequently heated, depending on necessity, at temperature of 900° to 1000° C. for more than 30 minutes for a secondary heat treatment so as to form an Al layer composed of compound layer or alloy layer having Al and Fe as main component on the ferrous base alloy workpiece.

By the method according to the present invention, aluminum coating layers with superior corrosion resistance at high temperatures and sufficient resistance against oxidation are formed on the ferrous base alloy workpieces through simple processing, with substantial elimination of disadvantages inherent in the conventional methods of the kind.

These and other objects and features of the present invention will become apparent from the following description taken in conjunction with the preferred embodiment thereof with reference to the accompanying drawings, in which;

FIGS. 1(*a*) and 1(*b*) are fragmentary schematic diagrams explanatory of an aluminum coating layer forming method according to the present invention, FIG. 2 is a graph showing relation between temperature rise for heating sample workpieces and amount of variation in weight of the sample workpieces according to the method of the present invention, FIG. 3 is a graph showing relation between temperature rise for heating sample workpieces and rate of weight variation of the sample workpieces according to the method of the present invention, FIG. 4 is a diagram similar to FIGS. 1(*a*) and 1(*b*), but particularly explanatory of a primary heat treatment according to the present invention, FIG. 5 is a diagram similar to FIGS. 1(*a*) and 1(*b*), but particularly explanatory of a secondary heat treatment according to the present invention, and FIG. 6 is a microscope photograph at magnifications of 100 showing a structure of the coating layer formed by the method of the present invention.

Before the description of the present invention proceeds, it is to be noted that like parts are designated by like reference numerals throughout several views of the accompanying drawings.

DETAILED DESCRIPTION OF THE INVENTION

In the first place, it is to be noted that the present invention is intended to solve the problems related to qualities of materials for the exhaust system components of motor vehicles and is intended to obtain ferrous base alloy materials having superior high temperature corrosion resistance and favorable resistance to oxidation at comparatively low cost. Accordingly, the present invention is applicable to any components or parts that require the Al plated layers. Additionally, from the viewpoint of the corrosion resistance at high temperatures, the present invention may also be applied to metallic materials in the form of plates, vessels, pipes, etc. which are required to be sufficiently usable in the presence of high temperature heavily corrosive medium generally containing halogen gas, halogen compounds, etc.

Figure 1:
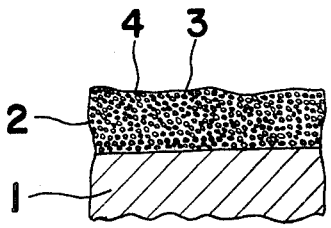
Figure 1:
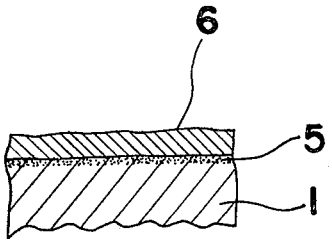

Referring now to the drawings, there are shown in FIG. 1 schematic diagrams illustrating the aluminum coating layer forming method according to the present invention.

In FIG. 1, coating liquid or solution 2 composed of Al or Al alloy particles 3, solvent-soluble resin 4 and solvent (not shown) for the synthetic resin is applied onto the surface of austenite stainless steel workpiece 1 (referred to as ferrous base alloy workpiece hereinbelow). The granular Al or Al alloy particles 3 should preferably have diameters in the range from 10 to 500μ, since those having particle diameter smaller than 10μ have a possibility that they are undesirably oxidized on the whole during heating, while those with diameters exceeding 500μ are not preferable due to settling during preservation of the coating solution, thus the optimum range thereof particularly preferable being in the region from 20 to 200μ. For the Al alloy as described above, Al-Cr alloy (2 to 10% of Cr with melting point at 800° C.), Al-Si alloy (5 to 10% of Si with melting point at 580° C.), etc. may be employed, while for the above synthetic resin, those having solvent-solubility at normal temperature, high decomposition burning temperature and slow burning speed, with sufficient adhesion are to be selected, and thus, vinyl acetate resin, methacrylate resin and urethane resin may be employed with favorable results. For the solvent, acetone, butyl acetate, thinner, etc., are to be employed, and in the case of aqueous emulsion, water may be used as a diluting agent.

The rate of Al or Al alloy particles 3 and the resin 4 to be mixed in the above coating solution 2 is 50 to 90% by weight for the former and 10 to 50% by weight for the latter, which are defined based on the fact that it is difficult to obtain uniform Al plated layers if the precentage of the Al alloy is below 50% by weight, while the application of the coating solution is obstructed due to reduction of the amount of the synthetic resin as binding agent if the percentage exceeds 90% by weight, thus the most preferable range being between 60 and 80% by weight. The solvent in the coating solution 2 is to adjust the viscosity of said coating solution to facilitate the application thereof onto the ferrous base alloy workpiece 1, and the viscosity should be suitably set depending on the methods of application, for example, spraying, application by a brush, etc. through variation of the amount of the solvent to suit the purpose.

Meanwhile, the amount of application of the coating solution 2 is to be determined according to the desired thickness of an Al plated layer 6 (FIG. 1(*b*)) to be formed on the surface of the ferrous base alloy workpiece 1.

The workpiece 1 applied with the coating solution 2 in the above described manner is heated up to such an extent as the solvent in the coating solution evaporates to dry and solidify the coating solution 2 for the formation of the resin coating layer containing Al on the surface of the workpiece 1.

Subsequently, the workpiece 1 treated as described above is heated up to a temperature higher than the melting point of the Al or Al alloy particles and more preferably to a temperature whereat the heating atmospheric temperature is higher than the melting point by approximately 100° C. for a sufficient time period until the Al or Al alloy particles have been completely melted so as to form the Al plated layer 6 on the surface of the workpiece 1. By the above heating, the synthetic resin in the coated layer is decomposed and scattered through reaction thereof with oxygen in the air, during which time, since the burning speed of the synthetic resin is slow, oxygen present around the workpiece 1 is consumed for the burning of the resin to render the atmosphere thereat neutral of reducing nature until the Al or Al alloy is completely melted, and thus, oxidation of Al is prevented, while diffusion of Al into the workpiece 1 is accelerated simultaneously. As a result, the Al plated layer 6 is formed through an Al diffusion layer 5 (FIG. 1(*b*)) on the surface of the workpiece 1.

Hereinbelow, examples and comparative experiments are set forth for the purpose of illustrating the present invention without any intention of limiting the scope thereof.

EXAMPLE 1

Figure 2:
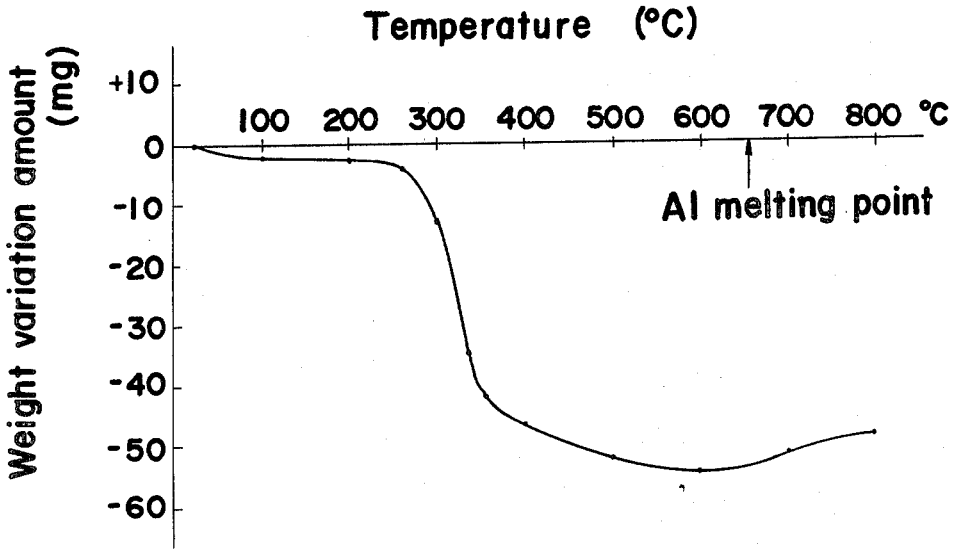
Figure 3:
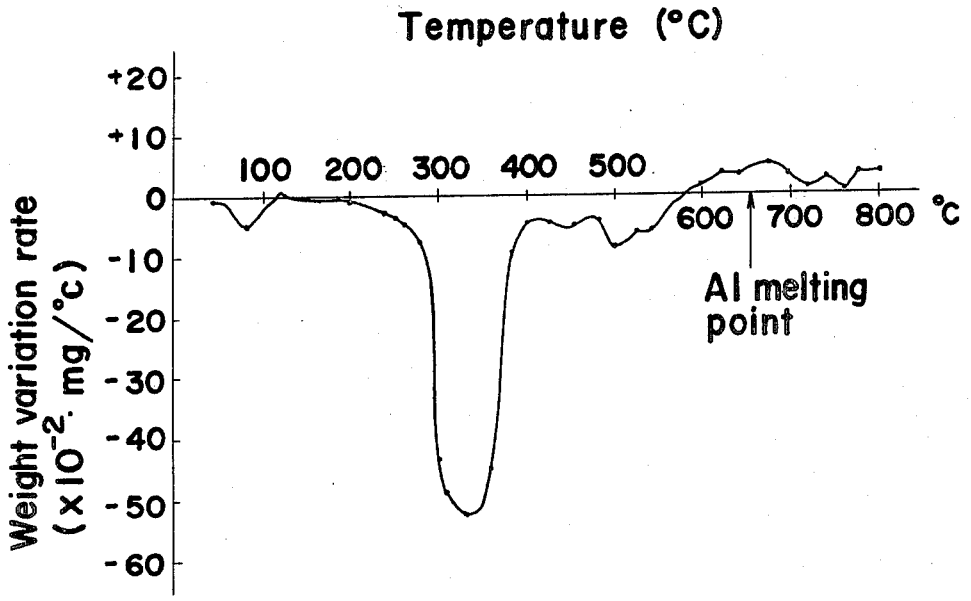

80% by weight aluminum particles (particle diameter 50μ), 20% by weight vinyl acetate resin and acetone as solvent were mixed and stirred to prepare the coating solution. The coating solution prepared in the above described manner was applied onto the surface of a sample stainless steel plate to be subsequently dried at normal temperature for causing the solvent to evaporate, and thus, a resin coated layer (100μ in thickness) containing the aluminum particles was formed on the stainless steel plate. The sample stainless steel plate on which the resin coated layer was formed as described above was heated from 20° C. up to 800° C. for 2 hours, and the results of weight variations of the sample stainless steel plate during such heating are shown in graphs of FIGS. 2 and 3. As is noticed from these graphs, the weight of the sample stainless steel plate is suddenly decreased from the vicinity of 250° C. indicating that the decomposition of the resin is rapidly proceeding. Upon further raising of the temperature, the resin is completely decomposed to show the minimum weight at a temperature of 600° C., and by the subsequent heating, the aluminum is slightly oxidized showing an increase in the weight of the sample stainless steel plate.

As is clear from the foregoing description, according to the present invention, the favorable Al plated coating layer can be readily formed through a simple processing.

The effects obtainable by the aluminum plated coating layer forming method according to the present invention may be summarized as follows.

(1) In the formation of plated coating layers, the plated coating layer superior in high temperature corrosion resistance can be obtained owing to the small degree of oxidation of the metal of the aluminum group.

(2) The thickness of the plated coating layer may be controlled as desired.

(3) Uniform plate coating layers are available even on workpieces of complicated configurations.

(4) Expensive facilities for melting the metal of aluminum group are not required, thus the Al plated coating layers being provided at low cost.

It is to be noted here that in the present invention, cast iron, carbon steel, stainless steel and various other ferrous base alloy materials may be employed for the ferrous base alloy workpieces.

According to the present invention, when a still higher corrosion resistance at high temperatures, etc. is required for the Al coating layer formed on the surface of the ferrous base alloy workpiece, the workpiece having the Al plated coating layer formed on the surface thereof in the manner as described in the foregoing is further subjected to heat treatment to form an Al compound layer mainly composed of Al-Fe compound on the surface of the workpiece.

Subsequently, the processing for the above heat treatment will be described.

Figure 4:
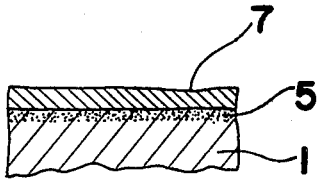

The ferrous base alloy workpiece having the aluminum plated coating layer formed on the surface thereof obtained in the manner as described in the foregoing is further maintained for a primary heat treatment at temperatures of 700° to 850° C. for more than 10 minutes and more preferably, for 30 minutes. By the primary heat treatment as described above, the aluminum of the plated layer reacts with iron as shown in FIG. 4 to form either Fe-Al compound ($Fe_2Al_5$, $Fe_4Al_{13}$), or Fe-Al-Cr or Fe-Al-Si compound for the formation of an Al compound layer 7 mainly composed of Fe-Al compound on the surface of the workpiece. The metallic compounds as described above have a strong adhesion with respect to the surface of the ferrous base alloy workpiece 1, with favorable corrosion resistance against the high temperature halogen atmosphere.

It should be noted here that if the temperature for the above heat treatment is less than 700° C., the metallic compounds as described above are difficult to be formed, while, on the other hand, if the temperature exceeds 850° C., the formed metallic compounds tend to be decomposed through internal diffusion of aluminum, resulting in the reduction of corrosion resistance against halogen. Additionally, if the time for the heat treatment is less than 10 minutes, sufficient formation of the above metallic compounds can not be expected. Although the heat treatment may be effected for a long period of time, the duration exceeding 120 minutes is insignificant to the stabilization of Al, and thus the time for the heat treatment should be limited to less than 120 minutes from the viewpoint of industrial production.

Although the workpieces subjected to the primary heat treatment as described above have superior high temperature corrosion resistance or resistance against oxidation, there may be cases where the degree of adhesion between the Al coating layer on the surface and the ferrous base alloy workpiece as base material is insufficient, depending on the end uses of the workpiece as a component member. In such a case, if a secondary heat treatment is effected as described hereinbelow, an Al alloy layer 8 (FIG. 5) having Al and Fe as main component is formed on the surface due to diffusion of Al into the workpiece as base material, with improved adhesion between the Al alloy layer and the base material. The above second heat treatment is effected depending on necessity, since the adhesion with respect to the base material is increased without losing the advantage by the primary heat treatment. In addition, in the case where the ferrous base alloy workpiece is of austenite stainless steel containing 10 to 30% Ni, Ni in the Al-Fe compound layer 7 and in the Al diffusion layer 5 gradually react with Al to be formed into a compound for fixing Ni, in which case, if the reaction is effected slowly, the heat generating reaction between Ni and Al is also made slow without corrosion of Fe taking place in the workpiece.

Figure 5:
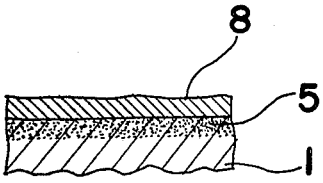

In the secondary heat treatment, the workpiece subjected to the primary heat treatment in the manner as described earlier is further maintained at temperatures of 900° to 1000° C. for 30 to 120 minutes for increasing the Al diffusion layer 5 so as to improve the adhesion between the Al compound layer 7 on the surface and the base material 1 as shown in FIG. 5.

It is to be noted here that in the secondary heat treatment as described above, the heating temperature is limited to 900° to 1000° C. because at temperatures less than 900° C., Ni is not sufficiently fixed due to insufficient diffusion of Al, and at temperatures exceeding 1000° C., the reaction between Ni and Al is so rapid that the base material, i.e., ferrous alloy workpiece 1 tends to be corroded. On the other hand, the duration of the heating was defined to be 30 to 120 minutes, since if it is less than 30 minutes, Ni is not sufficiently fixed, while if it exceeds 120 minutes, the effect thereby is undesirably saturated.

Subsequently, comparative tests for the high temperature corrosion resistant performance were carried out between unfinished sample steel plates and sample steel plates having the Al coating layers formed on the surfaces thereof according to the method of the present invention as described hereinbelow.

COMPARATIVE EXPERIMENT

With austenite stainless steel (AISI 310S) which contains 20% Ni employed as a ferrous base material, sample workpieces respectively applied, on their surface, with 7 kinds of coating solutions as tabulated below in Table 1 were prepared for comparative tests with separately prepared sample workpieces respectively subjected to the plating treatment, primary heat treatment and secondary heat treatment and also shown in Table 1.

TABLE 1

| Coating solution | Al particles wt % | Synthetic resin wt % | Solvent | Plating treatment | Primary heat treatment | Secondary heat treatment |
|---|---|---|---|---|---|---|
| 1 | Al 50 | Vinyl acetate 50 | Acetone | 720° C. 10 min. | 800° C. 60 min. | 950° C. 60 min. |
| 2 | Al 60 | Methacrylate 40 | " | " | " | " |
| 3 | Al 70 | Vinyl acetate 30 | " | " | " | " |
| 4 | Al-Si 70*1 | Vinyl acetate 30 | " | " | " | " |
| 5 | Al-Cr 70*2 | Vinyl acetate 30 | " | 850° C. 10 min. | 850° C. 60 min. | " |
| 6 | Al 80 | Vinyl acetate 20 | " | 720° C. 10 min. | 800° C. 60 min. | " |
| 7 | Al 90 | Vinyl acetate 10 | " | " | " | " |

*1Al—Si alloy containing 7% Si
*2Al—Cr alloy containing 4% Cr

For the aluminum particles, those having average diameter of 50μ were employed to prepare samples having the Al plated layers of 50μ thick formed thereon in the plated state.

With employment of the samples as described above and unfinished austenite stainless steel, middle shells (total surface area 200 $cm^2$) (not shown) for heat exchangers were produced, and tests were carried out by causing aqueous solution of 3% salt to be absorbed into heat insulating material covering the surfaces of the middle shells for subsequent heating at a temperature of 800° C. for 1 hour to form one cycle of treatment, and after repeating the cycle 10 times, corrosion of the middle shells were evaluated by measuring the plate thickness-reduction thereof, the results of which are shown in Table 2 below.

TABLE 2

| | | No.-treatment mm | Plating treatment mm | Primary heat treatment mm | Secondary heat treatment mm |
|---|---|---|---|---|---|
| Base material as it is | | 0.7 | | | |
| Those applied with coating | 1 | | 0.65 | 0.10 | 0.2 |
| | 2 | | 0.65 | 0 | 0.15 |
| | 3 | | 0.64 | 0 | 0.15 |
| | 4 | | 0.65 | 0 | 0.13 |

TABLE 2-continued

| | | No.-treatment mm | Plating treatment mm | Primary heat treatment mm | Secondary heat treatment mm |
|---|---|---|---|---|---|
| solution | 5 | | 0.50 | 0 | 0.05 |
| | 6 | | 0.65 | 0 | 0.15 |
| | 7 | | 0.64 | 0.05 | 0.2 |

As is seen from the above Table 2, in the present invention, samples subjected to the primary heat treatment after the plating treatment have superior corrosion resistance against the halogen atmosphere at high temperatures.

According to the present invention, since it is so arranged that the workpiece is applied with the coating solution composed of the Al particles and special synthetic resin, with subsequent heating thereof up to the temperature above the melting point of Al to burn the synthetic resin for simultaneous melt-plating, the Al plated coating layer can readily be formed on the ferrous base alloy workpiece through simple processing. Furthermore, by conveniently forming the Al plated coating layer only of required thickness at necessary portions alone as described above, and further subjecting the Al plated coating layer to the primary heat treatment at temperatures of 700° to 850° C. for more than 10 minutes in the atmosphere, the coating layer only of necessary thickness can be formed at required portions in a simple manner to provide components and parts having superior high temperature corrosion resistance.

Figure 6:
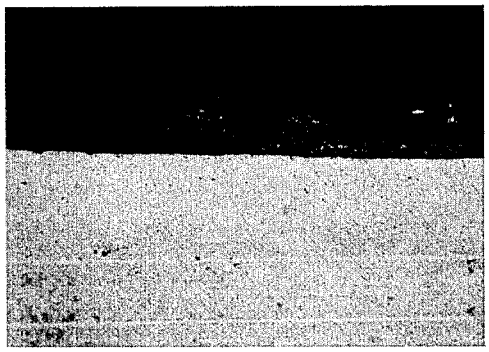

Moreover, if the workpieces subjected to the primary heat treatment are further treated for the secondary heating at temperatures of 900° to 1000° C. for more than 30 minutes, high temperature corrosion resistance is markedly improved as compared with the non-finished workpieces, resulting in practical application, although the workpieces thus treated may be slightly inferior to those subjected only to the primary heat treatment. In the secondary heat treatment as described above, aiming at the improvement of adhesion between the Al coating layer and the base material or workpiece, the degree of adhesion therebetween is increased through growth of the Al diffusion layer as is noticed from the microscope photograph in FIG. 6. Moreover, in the case where the base material is of austenite stainless steel containing 10 to 30% Ni, the above secondary heat treatment is effective for stabilization of Ni through the heat generating reaction between Al and Ni.

EXAMPLE 2

For the purpose of carrying out tests for resistance against oxidation, a coating solution composed of 70% by weight aluminum particles (average particle diameter 50μ), 30% by weight of vinyl acetate resin, and acetone as solvent was applied onto the surface of a steel plate to a thickness of 1.5 mm, and after drying for solidification, was heated at a temperature of 720° C. for 30 minutes in the atmosphere to form an Al plated layer of 50μ in thickness on the steel plate through the Al diffusion layer. The plated steel plate thus obtained was subjected to the primary heat treatment at a temperature of 800° C. for 60 minutes in the atmosphere to convert Al in the plated layer into the compound of Al-Fe ($FeAl_3$, $Fe_2Al_5$), and subsequently to the secondary heat treatment at a temperature of 950° C. for 60 minutes in the atmosphere so as to fix Ni in the Al-Fe compound layer and Al diffusion layer. By the treatments as described above, the oxidation resistant coating layer composed of the Al diffusion layer and Al-Fe compound layer was formed on the surface of the steel plate.

Test pieces were prepared from the steel plate treated as in EXAMPLE 2 for oxidation resistant tests as described hereinbelow.

OXIDATION RESISTANCE TESTS

Testing procedures

The test pieces each having dimensions of 2.0 mm in thickness, 50 mm in width and 100 mm in length were heated together with comparative test pieces without any treatment in a furnace (not shown) up to a temperature of 1120° C. in the atmosphere, and after having been maintained at the temperature for 20 hours, measured for reduction in the amount per unit area of the test pieces due to oxidation, the results of which are shown in Table 3 below. It is seen from Table 3 that the test pieces according to the present invention show a marked decrease in the reduction of amount due to the oxidation with improved high temperature oxidation resistance as compared with the comparative test pieces without treatment.

TABLE 3

| | Amount reduction due to oxidation ($mg/cm^2$) |
|---|---|
| Test piece of the present invention | 1.5 |
| Comparative test piece SUS 310S (without treatment) | 9.4 |

As is clear from the above test results, according to the present invention, the coating layer having superior oxidation resistance is readily available on the surface of the austenite stainless steel plate through simple processing.

Although the present invention has been fully described by way of example with reference to the attached drawings, it is to be noted that various changes and modifications are apparent to those skilled in the art. Therefore, unless such changes and modifications depart from the scope of the present invention, they should be construed as included therein.

What is claimed is:

1. A method of forming an aluminum coating layer on the surface of a workpiece of austenite stainless steel which comprises the steps of applying onto the surface of the stainless steel workpiece a coating solution containing 50 to 90% by weight of aluminum or aluminum alloy particles of 10 to 500μ and 10 to 50% by weight of a vinyl acetate resin having a high decomposition burning temperature with slow burning speed and being soluble in a solvent at normal temperature, with subsequent drying thereof to form a resin coating layer containing aluminum on the surface of the stainless steel workpiece, and thereafter subjecting said workpiece thus treated to heating to a temperature higher than melting point of the aluminum or aluminum alloy particles so as to form an Al plated layer on the surface of said stainless steel workpiece;

then heating said stainless steel workpiece having the Al plated layer on the surface thereof at temperatures of 700° to 850° C. for more than 10 minutes to form a compound layer mainly composed of Fe-Al on the surface of said stainless steel workpiece; and heating said stainless steel workpiece having said compound layer formed on the surface thereof at temperatures of 900° to 1000° C. for more than 30 minutes to form an Al alloy layer mainly composed of Al and Fe on the surface of said stainless steel workpiece.

2. The method of claim 1 wherein said aluminum alloyed particles are at least one member selected from the group consisting of Al-Cr and Al-Si.

* * * * *